US011255119B2

(12) United States Patent
Krause

(10) Patent No.: US 11,255,119 B2
(45) Date of Patent: Feb. 22, 2022

(54) STRUCTURAL WINDOWSILL ASSEMBLY

(71) Applicant: Advanced Architectural Products, LLC, Allegan, MI (US)

(72) Inventor: G. Matt Krause, Allegan, MI (US)

(73) Assignee: Advanced Architectural Products, LLC, Allegan, MI (US)

( * ) Notice: Subject to any disclaimer, the term of this patent is extended or adjusted under 35 U.S.C. 154(b) by 0 days.

(21) Appl. No.: 16/912,647

(22) Filed: Jun. 25, 2020

(65) Prior Publication Data

US 2020/0408029 A1 Dec. 31, 2020

Related U.S. Application Data

(60) Provisional application No. 62/867,623, filed on Jun. 27, 2019.

(51) Int. Cl.
*E06B 1/70* (2006.01)

(52) U.S. Cl.
CPC ..... *E06B 1/702* (2013.01)

(58) Field of Classification Search
CPC ..... E06B 1/702
See application file for complete search history.

(56) References Cited

U.S. PATENT DOCUMENTS

| | | | | |
|---|---|---|---|---|
| 6,749,163 | B1 * | 6/2004 | Lee | A47B 96/027 248/236 |
| 10,087,678 | B2 * | 10/2018 | Pettibone | E06B 7/14 |
| 10,472,882 | B1 * | 11/2019 | Pettibone | E06B 1/702 |
| 2006/0265977 | A1 * | 11/2006 | Powers, Jr. | E06B 1/702 52/204.5 |
| 2008/0282626 | A1 * | 11/2008 | Powers, Jr. | E06B 1/702 52/204.1 |
| 2013/0055652 | A1 * | 3/2013 | Larsson | E04D 13/1415 52/60 |
| 2014/0260011 | A1 * | 9/2014 | Pettibone | E06B 7/26 52/209 |
| 2018/0216401 | A1 * | 8/2018 | Broad | E06B 7/26 |
| 2020/0408029 | A1 * | 12/2020 | Krause | E06B 1/003 |

* cited by examiner

*Primary Examiner* — Andrew J Triggs
(74) *Attorney, Agent, or Firm* — The Watson IP Group, PLC; Jovan N. Jovanovic

(57) ABSTRACT

A windowsill assembly includes a beam member and an insert bracket. The beam member includes a first leg and a second leg, the first leg meeting the second leg at a joining region at proximal ends of the first leg and the second leg. The insert bracket includes a first portion and a second portion that are substantially perpendicular to each other to substantially match an angle between the first leg and the second leg of the beam member. The insert bracket couples the beam member to a support member.

18 Claims, 6 Drawing Sheets

STRUCTURAL WINDOWSILL ASSEMBLY

CROSS-REFERENCE TO RELATED APPLICATION

This application claims priority from U.S. Provisional Patent Application Ser. No. 62/867,623, filed Jun. 27, 2019, entitled "Structural Windowsill Assembly", the entire specification of which is hereby incorporated by reference in its entirety.

BACKGROUND OF THE DISCLOSURE

1. Field of the Disclosure

The disclosure relates in general to building materials, and more particularly, to a structural windowsill assembly that can provide support for continuous insulation punched openings, among other uses.

2. Background Art

Windows as well as other structures that span openings in walls are known in the art. There are a number of structures by which to provide adequate support to the spanning structure while providing adequate insulation and adequate structural support for these structures that span the openings.

SUMMARY OF THE DISCLOSURE

The disclosure is directed to a windowsill assembly comprising a beam member and an insert bracket. The beam member includes a first leg and a second leg, the first leg meeting the second leg at a joining region at proximal ends of the first leg and the second leg. The insert bracket includes a first portion and a second portion that are substantially perpendicular to each other to substantially match an angle between the first leg and the second leg of the beam member. The insert bracket couples the beam member to a support member.

The disclosure is also directed to a method of installing a windowsill assembly comprising coupling the windowsill assembly to a support member. The beam member includes a first leg and a second leg, the first leg meeting the second leg at a joining region at proximal ends of the first leg and the second leg. The insert bracket includes a first portion and a second portion that are substantially perpendicular to each other to substantially match an angle between the first leg and the second leg of the beam member. The insert bracket couples the beam member to the support member.

In some configurations, the insert bracket includes a transverse slot, the windowsill assembly further comprising an inner mount bracket including a first portion and a second portion to extend through the transverse slot.

In some configurations, the second portion of the insert bracket includes at least one fastener opening to couple the beam member to the support member.

In some configurations, the first leg includes a first slot, at a distal end of the first leg, to accept a distal end of a first portion of the insert bracket.

In some configurations, the first slot includes a lower leg that is spaced apart from and perpendicular to the first leg.

In some configurations, the second leg includes a second slot, at a distal end of the second leg, to accept a distal end of a second portion of the insert bracket.

In some configurations, the beam member is comprised of a plurality of elongated fibers embedded within an elongated matrix.

In some configurations, the plurality of elongated fibers include at least one of glass fibers, basalt fibers, carbon fibers, s-glass fibers, and e-glass fibers.

In some configurations, the insert bracket is at least one of a metal material and a fiber reinforced plastic material.

In some configurations, the second portion includes a plurality of fastener openings to accept a plurality of fasteners to secure the beam member against a support member.

In some configurations, the support member is at least one of a wall and a window frame.

BRIEF DESCRIPTION OF THE DRAWINGS

The disclosure will now be described with reference to the drawings wherein.

DETAILED DESCRIPTION OF THE DISCLOSURE

Figure 1:
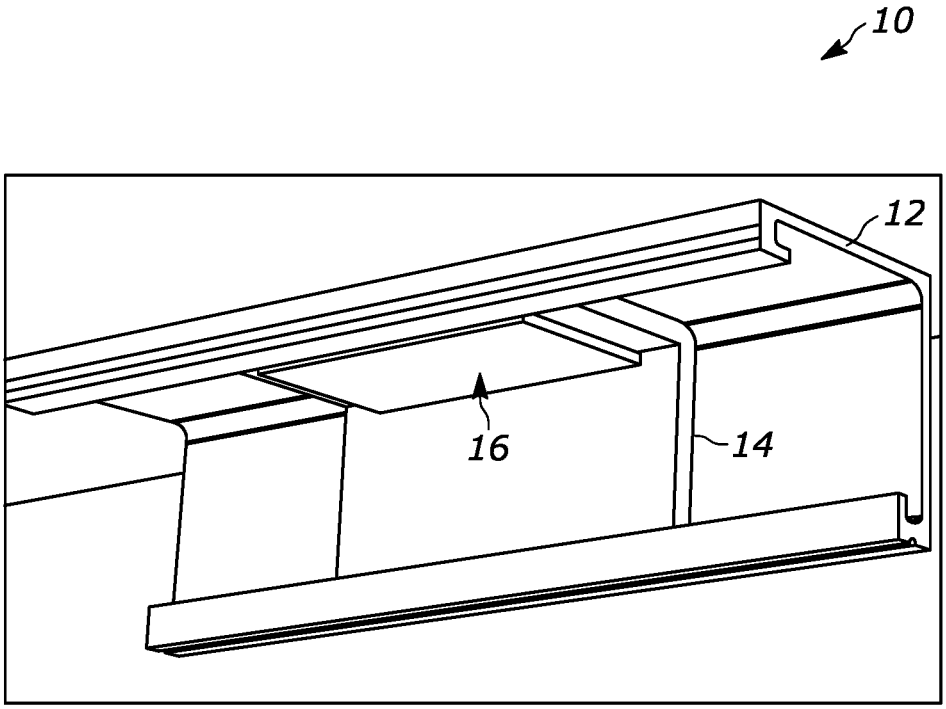
FIG. 1 of the drawings is a lower perspective view of the windowsill assembly, in accordance with at least one embodiment disclosed herein.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
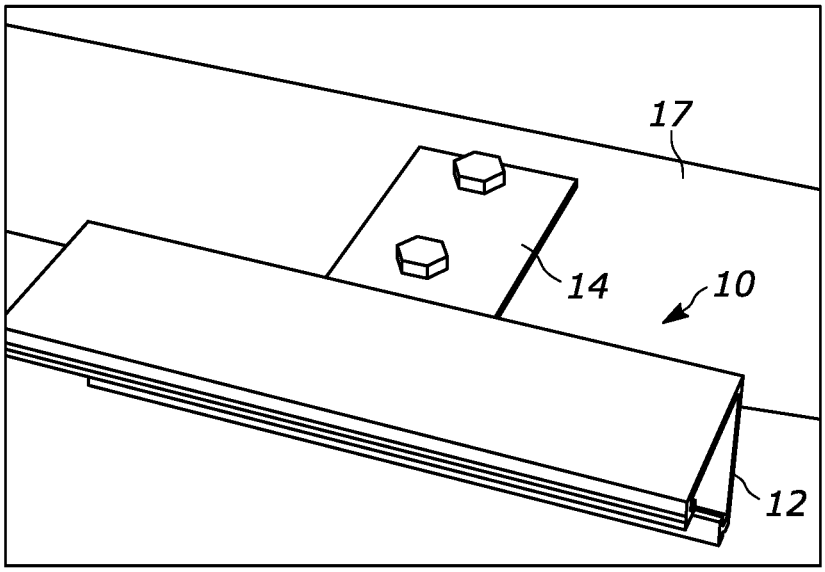
FIG. 2 of the drawings is a upper perspective view of the windowsill assembly, in accordance with at least one embodiment disclosed herein.
Figure 3:
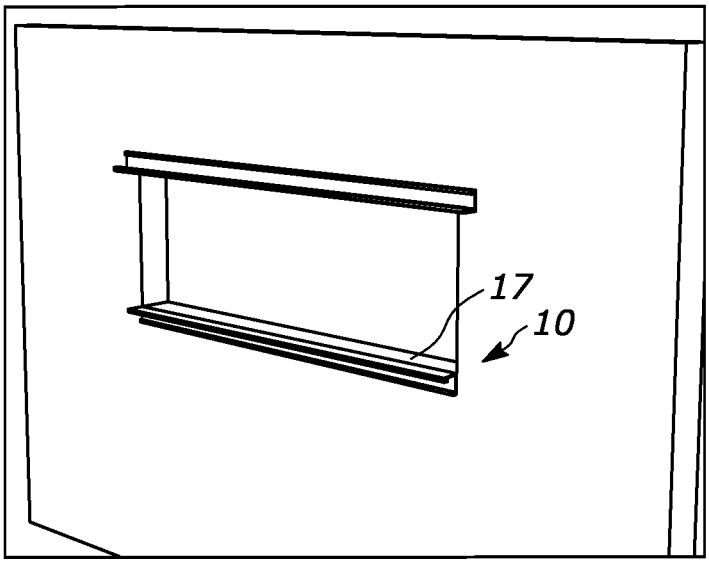
FIG. 3 of the drawings is a wall showing a pair of windowsill assemblies positioned about the opening, in accordance with at least one embodiment disclosed herein.
Figure 4:
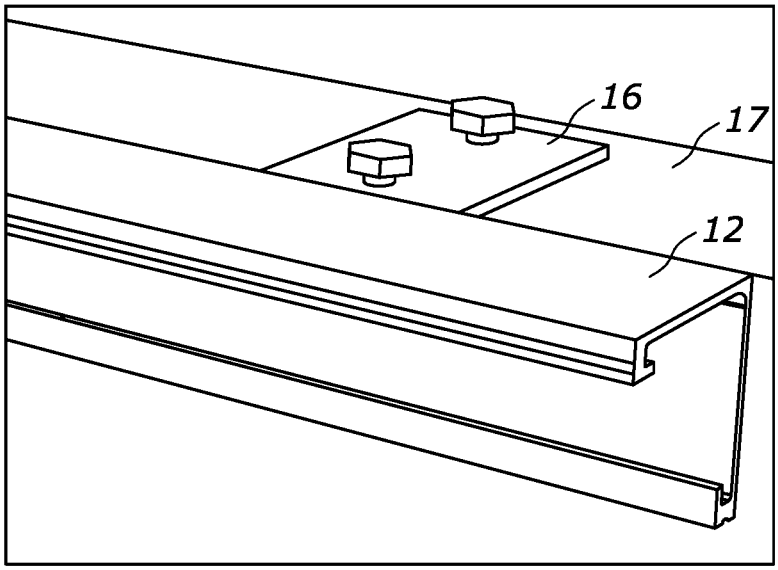
FIG. 4 of the drawings is an upper perspective view of the windowsill assembly, in accordance with at least one embodiment disclosed herein.
Figure 5:
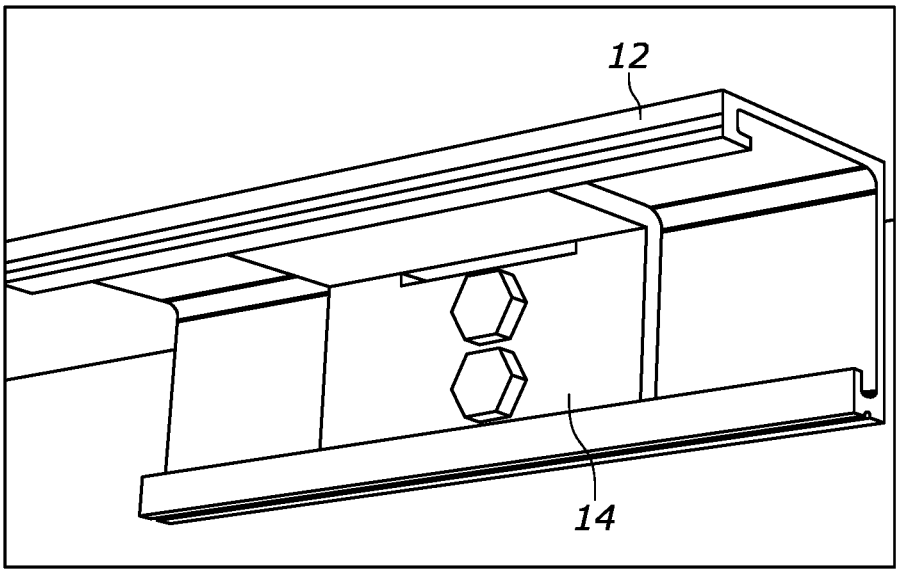
FIG. 5 of the drawings is a lower perspective view of the windowsill assembly, without an insert mount bracket, in accordance with at least one embodiment disclosed herein.
Figure 6:
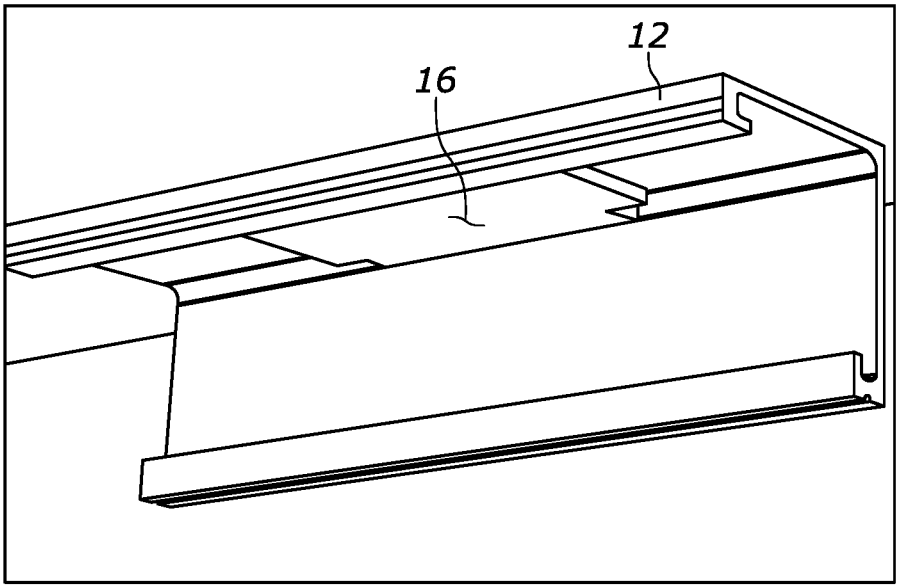
FIG. 6 of the drawings is a lower perspective view of the windowsill assembly, without the insert bracket, in accordance with at least one embodiment disclosed herein.

Referring now to the drawings and in particular to FIGS. 1 through 6 the windowsill assembly is shown at 10. In at least one embodiment, the windowsill assembly 10 includes a beam member 12, an insert bracket 14, and an inner mount bracket 16. With particular reference to FIG. 3, the windowsill assembly 10 can be coupled to a support member, such as a wall 19 or window frame 17 proximate an opening (e.g., a window opening), via a method of installing the windowsill assembly 10. A similar configuration is shown in FIGS. 2 and 4. It will be understood that the configuration shown provides a sill or other type of assembly for punched openings, such as for windows, doors, ribbon windows among other structures. In the configuration shown, the windowsill assembly 10 allows for windows and the like to be mounted in the thermal plane of continuous insulation without the need for structural steel angles, combustible wood or steel light gauge framing, among other benefits. It is contemplated that the configuration is water and vapor proof, fire rated (NFPA and ASTM E84), does not require thru fasteners or thru clips, can carry a dead load and/or a live load, does not require flange windows or strap tie backs as well as being universal.

Figure 7:
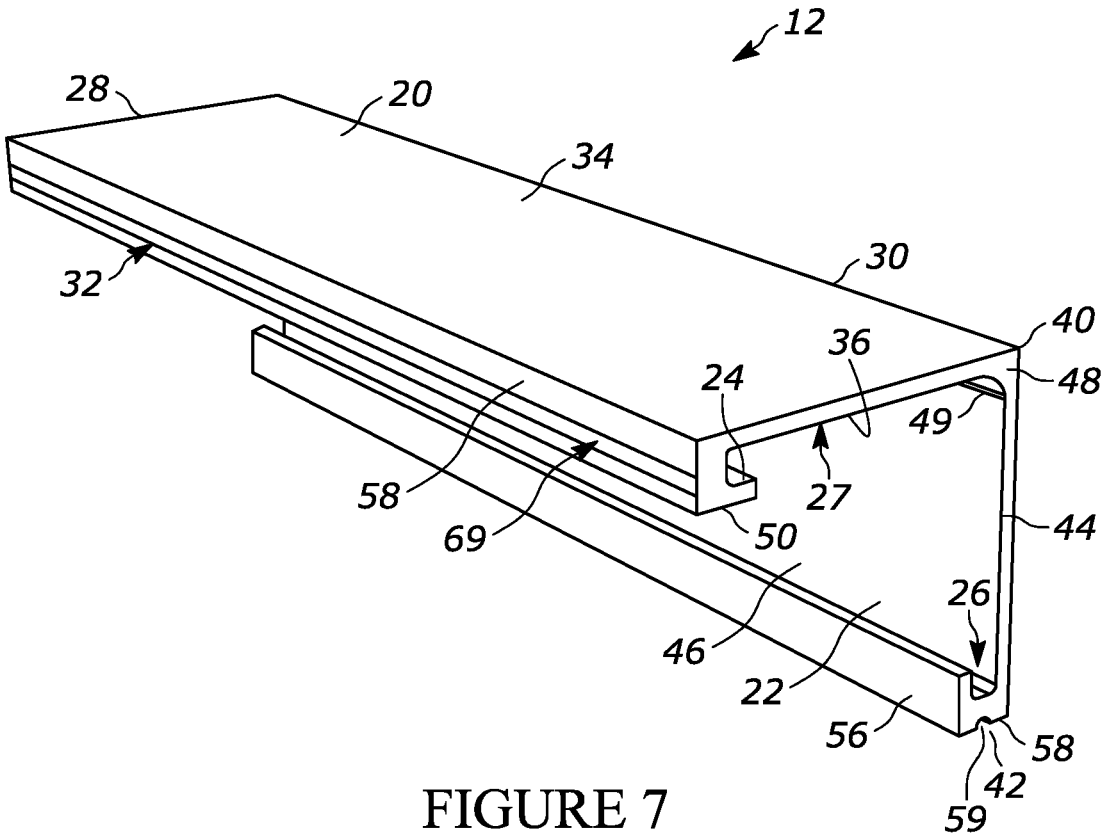
FIG. 7 of the drawings is a perspective view of the beam member, in accordance with at least one embodiment disclosed herein.

In greater structural detail, the beam member 12 is shown in FIG. 7 as comprising first leg 20, second leg 22, first slot 24 and second slot 26. In at least one embodiment, the beam member 12 is formed from a plurality of elongated fibers (parallel fibers and/or woven fabric) embedded within an elongated matrix. In the configuration shown, it is contemplated that the beam member 12 can be formed through pultrusion processes, while other configurations are contemplated. In some configurations, the beam member 12 can be formed from glass fibers, along with various different fibers, including but not limited to basalt fibers, carbon fibers, various s-glass, e-glass and other fibers. Other composite structures are likewise contemplated. The beam member 12 extends from first end 27 to second end 28. It will be understood that various different lengths are contemplated for use, and a number of different lengths may be utilized without departing from the scope of the present disclosure. For example, although the beam member 12 is shown as substantially (+−5%) corresponding to a width of a window frame 17, the beam member 12 can be wider or less wide than the window frame 17, without departing from the scope of the embodiment(s) disclosed herein.

The first leg 20 includes a proximal end 30 and a distal end 32, as well as defining outer surface 34 and inner surface 36. The second leg 22 includes proximal end 40, distal end 42, outer surface 44 and inner surface 46. The proximal ends of the first leg 20 and the second leg 22 meet at joining region 48 which has an inner filled region 49 that provides an additional thickness from the point to the inner surface 46 of the fillet perpendicular to the fillet. In the configuration shown, the first and second legs 20, 22 are substantially (+−5%) planar in configuration (the outer surfaces thereof) and substantially (+−5%) perpendicular to each other (while other relative angles are contemplated).

Figure 8:
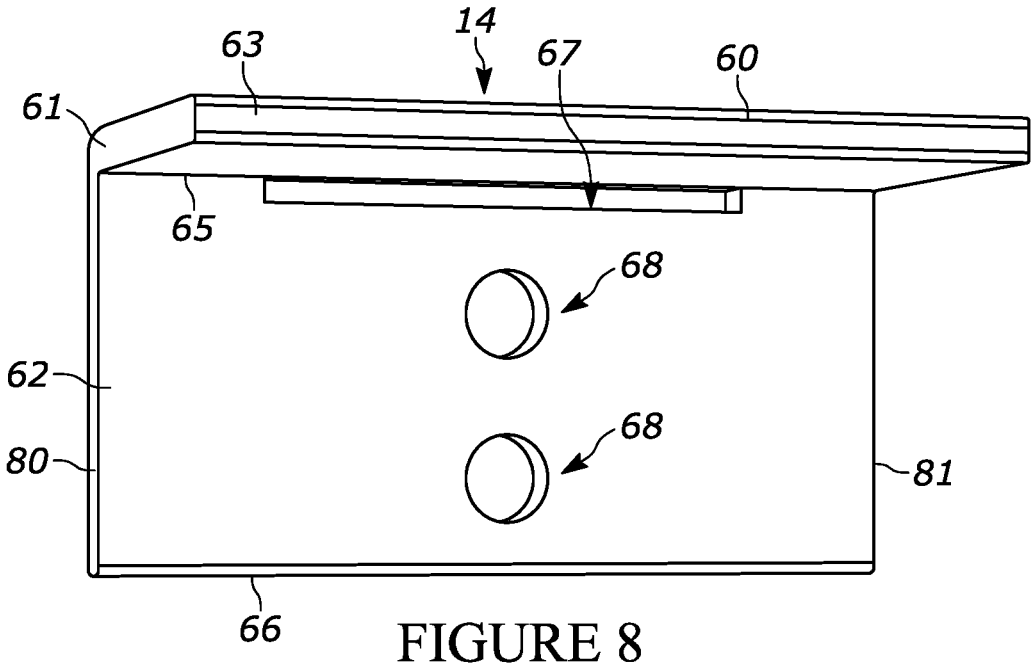
FIG. 8 of the drawings is a perspective view of the insert bracket member, in accordance with at least one embodiment disclosed herein.
Figure 9:
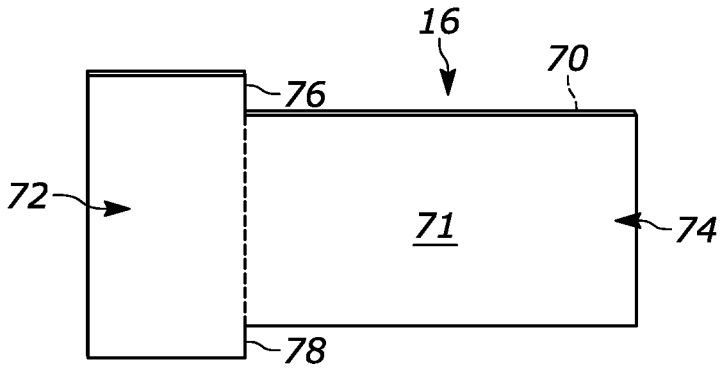
FIG. 9 of the drawings is a perspective view of the inner mount bracket, in accordance with at least one embodiment disclosed herein.
Figure 10:
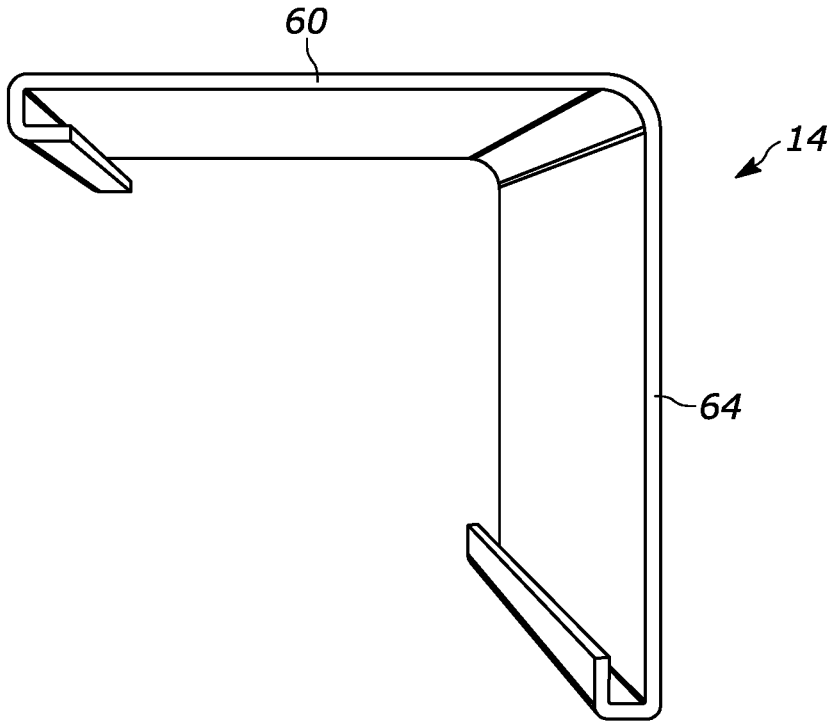
FIG. 10 of the drawings is a perspective view of an alternate configuration of the insert bracket, in accordance with at least one embodiment disclosed herein.

The first slot 24 is defined at the distal end 32 of the first leg 20, extending along a length of the first leg 20. The first slot 24 includes lower leg 50 and outward surface 52. The lower leg 50 is spaced apart from and perpendicular to the first leg 20, so as to define the slot which can have a number of differently configured cross-sectional configurations. A groove 53 may extend along the outward surface 53 between the first end and the second end of the beam member 12. The first slot 24 can accept a distal end 63 of a first portion 60 of the insert bracket 14 and the second slot 26 can accept a distal end 66 of a second portion 62, as shown in FIG. 8.

The second slot 26 is defined at the distal end of the second leg 22. The second slot 26 is substantially identical to the first slot 24 and includes inner leg 56 which is spaced apart from and perpendicular to the second leg 22. Outward surface 58 extends between the inner leg and the second leg 22. A groove 59 extends along the outward surface between the first and second ends of the beam member 12.

The insert bracket 14 is shown as comprising the first portion 60, the second portion 62 and a transverse slot 67. The insert bracket 14 is formed from a metal material or from a fiber reinforced plastic material (i.e., composite) while other configurations are contemplated. The first portion 60 includes a proximal end 61 and the distal end 63. The second portion 62 includes a proximal end 65 and a distal end 66. In the configuration shown, the first portion 60 and the second portion 62 are substantially (+−10 degrees) perpendicular to each other (to substantially (+−5%) match an angle between the first and second legs 20, 22 the beam member 12). The insert bracket 14 extends between a first end 80 and a second end 81. It will be understood that the insert bracket 14 is configured to be slid into position with the proximal distal ends being positioned into the respective first and second slot 24, 26. In the configuration shown, the surfaces of the insert bracket 14 and the inner surfaces of the first leg 20 and the second leg 22 are in, preferably, close abutment.

In at least one embodiment, a transverse slot 67 extends through the second portion 62 at the proximal end 65 thereof, between the first end 80 and the second end 81. The transverse slot 67, as will be explained, is configured to receive the inner mount bracket 16 and is generally of a width that corresponds to the width of the second portion 74 of the insert bracket 14. A plurality of fastener openings, such as fastener openings 68 can be defined in the second portion 62. The fastener openings 68 accept fasteners, such as bolts and/or screws, to secure the beam member 12 against a support member, such as the wall 19 (FIG. 11), as shown.

The inner mount bracket 16 comprises a substantially planar member having a first portion 72, a second portion 74 which, at a joint thereof, define first flange 76 and second flange 78. The inner mount bracket 16 defines a substantially planar first surface 70 and second surface 71. It is contemplated that the inner mount bracket 16 may be formed from a metal member such as a stainless steel or a fiber reinforced plastic. In at least one embodiment, an opening(s) may be defined in the second portion (and/or in the first portion) of the inner mount bracket 16. The second portion 74 of the inner mount bracket 16 can include at least one opening to accept fastener(s) (e.g., bolts and/or screws) to secure the beam member 12 against a support surface, such as a window frame, as shown in FIGS. 2 and 4.

Figure 11:
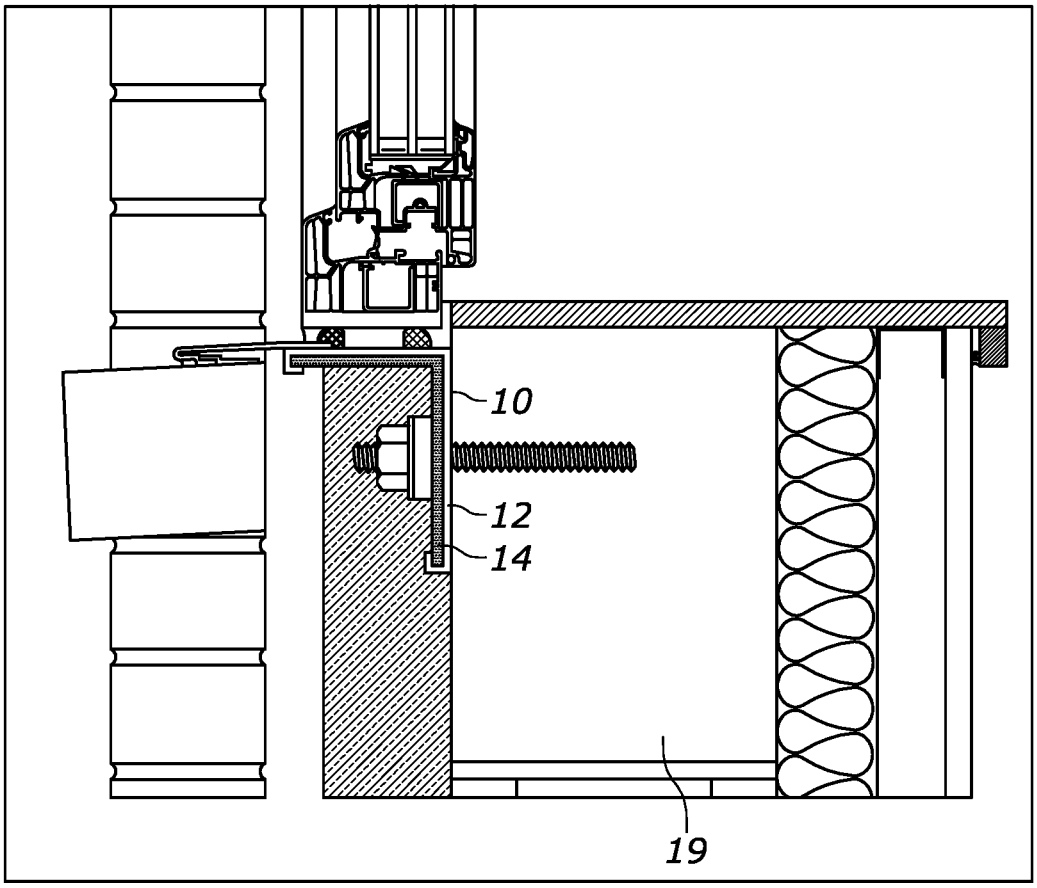
FIG. 11 of the drawings is a cross-sectional view of a wall configuration having the windowsill assembly, in accordance with at least one embodiment disclosed herein.

One illustrative example of the windowsill assembly 10 in a wall configuration is shown in FIG. 11. Other examples are shown in FIGS. 1 through 6. It will be understood that in such a configuration, the beam member 12 is coupled to the wall 19 with any number of different types of fasteners (some of which will depend on the type of material to which the beam member 12 is coupled), such as bolts and/or screws. The beam member 12 is positioned such that the outer surface 44 of the second leg 22 abuts the wall.

Next, with the insert bracket 14 slid within the channels formed by the cooperation of the structures of the beam member 12 including the slots 24, 26. Once positioned as desired, fasteners are extended through the second portion 74 of the insert bracket 14 and through the second leg 22 of the beam member 12 into the wall 19.

In some configurations, a plurality of the insert bracket 14 can be slidably coupled to the beam member 12 at spaced apart intervals. It is also contemplated that the plurality of the insert bracket 14 can be substantially identical, or alternatively can be different in configuration.

In at least one embodiment, a slot may be formed into the second leg 22 of the beam member 12 which can correspond to the transverse slot 67. The two structures can be aligned, and the inner mount bracket 16 can be inserted through these slots, so that the first leg 20 is in an abutting relationship with the first portion 60 of the insert bracket 14 while the second portion 74 overlies a flat portion of the sill configuration or window frame 17. While the second portion 74 is sized so as to fit through the transverse slot 67, the first and second flanges 76, 78 preclude the passage of the first portion 72 through the transverse slot 67.

Among other advantages, the foregoing embodiment(s) provides advantages that include, but are not limited to: is best practice, water proof design, vapor proof design, structural, fire rated (NFPA and ASTM e84)—by configuring it with ss clip tabs/interior clip angle for poly iso ins for fire rating or FRP for mineral wool insulation, non-sequential install, can be installed after insulation and cladding, ease of install, no thru-fasteners, no thru-clips, universal insulation, commercial, high r value, carries dead load and live load, t-clip install, no requirement for flange windows, or strap tie backs, and, thermally broken.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A windowsill assembly, comprising:

a beam member, of the windowsill assembly, including a first leg and a second leg, the first leg meeting the second leg at a joining region at proximal ends of the first leg and the second leg;

an insert bracket, including a first portion and a second portion that are substantially perpendicular to each other to substantially match an angle between the first leg and the second leg of the beam member, to couple the beam member to a support member, the insert bracket further including a transverse slot; and an inner mount bracket including a first portion and a second portion to extend through the transverse slot.

2. The windowsill assembly according to claim 1, wherein the second portion of the insert bracket includes at least one fastener opening to couple the beam member to the support member.

3. The windowsill assembly according to claim 1, wherein the first leg includes a first slot, at a distal end of the first leg, to accept a distal end of the first portion of the insert bracket.

4. The windowsill assembly according to claim 3, wherein the first slot includes a lower leg that is spaced apart from and perpendicular to the first leg.

5. The windowsill assembly according to claim 1, wherein the second leg includes a second slot, at a distal end of the second leg, to accept a distal end of the second portion of the insert bracket.

6. The windowsill assembly according to claim 1, wherein the beam member is comprised of a plurality of elongated fibers embedded within an elongated matrix.

7. The windowsill assembly according to claim 6, wherein the plurality of elongated fibers include at least one of glass fibers, basalt fibers, carbon fibers, s-glass fibers, and e-glass fibers.

8. The windowsill assembly according to claim 1, wherein the insert bracket is at least one of a metal material and a fiber reinforced plastic material.

9. The windowsill assembly according to claim 1, wherein the second portion includes a plurality of fastener openings to accept a plurality of fasteners to secure the beam member against the support member.

10. The windowsill assembly according to claim 1, wherein the support member is at least one of a wall and a window frame.

11. A method of installing a windowsill assembly, comprising:

coupling the windowsill assembly to a support member; wherein the windowsill assembly comprises:

a beam member, of the windowsill assembly, including a first leg and a second leg, the first leg meeting the second leg at a joining region at proximal ends of the first leg and the second leg;

an insert bracket, including a first portion and a second portion that are substantially perpendicular to each other to substantially match an angle between the first leg and the second leg of the beam member, to couple the beam member to the support member, the insert bracket further including a transverse slot; and an inner mount bracket including a first portion and a second portion to extend through the transverse slot.

12. The method of installing the windowsill assembly according to claim 11, wherein the second portion of the insert bracket includes at least one fastener opening to couple the beam member to the support member.

13. The method of installing the windowsill assembly according to claim 11, wherein the first leg includes a first slot, at a distal end of the first leg, to accept a distal end of the first portion of the insert bracket.

14. The method of installing the windowsill assembly according to claim 13, wherein the first slot includes a lower leg that is spaced apart from and perpendicular to the first leg.

15. The method of installing the windowsill assembly according to claim 11, wherein the second leg includes a second slot, at a distal end of the second leg, to accept a distal end of the second portion of the insert bracket.

16. The method of installing the windowsill assembly according to claim 11, wherein the beam member is comprised of a plurality of elongated fibers embedded within an elongated matrix.

17. The method of installing the windowsill assembly according to claim 11, wherein the insert bracket is at least one of a metal material and a fiber reinforced plastic material.

18. The method of installing the windowsill assembly according to claim 11, wherein the second portion includes a plurality of fastener openings to accept a plurality of fasteners to secure the beam member against the support member.

* * * * *